United States Patent [19]

Heng et al.

[11] Patent Number: 4,846,722

[45] Date of Patent: Jul. 11, 1989

[54] ARRANGEMENT FOR ELECTRICAL CONNECTIONS AND IN PARTICULAR A JUNCTION BLOCK

[75] Inventors: Jean-Paul Heng, Lyons; Jean-Claude Bidal, Reyrieux; René Curvat, Rillieux la Pape, all of France

[73] Assignee: OGEE Alsthom, France

[21] Appl. No.: 242,463

[22] Filed: Sep. 9, 1988

[30] Foreign Application Priority Data

Sep. 10, 1987 [FR] France ..... 87 12551

[51] Int. Cl.[4] ..... H01R 4/24

[52] U.S. Cl. ..... 439/439; 439/441; 439/716

[58] Field of Search ..... 439/786, 787, 436–441, 439/806, 807, 833, 836, 828, 716

[56] References Cited

U.S. PATENT DOCUMENTS 3,474,389 10/1969 Nagano ..... 439/440

FOREIGN PATENT DOCUMENTS 1254214 11/1967 Fed. Rep. of Germany ..... 439/438
1285587 12/1968 Fed. Rep. of Germany ..... 439/439
2511444 9/1976 Fed. Rep. of Germany ..... 439/441
3019149 11/1981 Fed. Rep. of Germany .
3418536 11/1985 Fed. Rep. of Germany ..... 439/438
1049581 12/1953 France .
1552600 1/1969 France .
0293258 12/1953 Switzerland ..... 439/439

*Primary Examiner*—David Pirlot
*Attorney, Agent, or Firm*—Sughrue, Mion, Zinn, Macpeak & Seas

[57] ABSTRACT

An arrangement allows the end of an electrical conductor (2) to be secured by clamping by a spring leaf (9) against a conductive connecting wall (6) in a compartment of a case of insulating material into which the end of the conductor is inserted. Arrangement includes at least one pushable member (10) for compressing the spring leaf, which penetrates the compartment in which the leaf is located and which is maneuverable from the outside of the case between two positions, one in which the spring leaf is relaxed and allows the end of a conductor to be freely inserted, the other in which the spring leaf is flexed by the urging of the pushing member and bears against the connecting wall.

7 Claims, 2 Drawing Sheets

ARRANGEMENT FOR ELECTRICAL CONNECTIONS AND IN PARTICULAR A JUNCTION BLOCK

This invention concerns arrangements for electrical connections in which a stripped end of electrical wire, or a pin or lug-fitted end thereof, is pushed into intimate contact with a conductive wall by a spring leaf inside a case of insulating material.

The use of a blade or spring leaf to hold and secure the conductive core of an electrical wire, having been previously stripped of its insulating sheath, against a fixed conductive wall in a cage housed in a hollow part of an insulating body has been known for a long time, as can be seen for example from French Pat. No. 1,049,581.

Technological progress has prompted those skilled in the art to miniaturize the component parts used to make such connective arrangements, to encapsulate the conductive parts within the insulating cases thereof and to add maneuvering parts thereto enabling one to act upon the wire-clamping blades to install a wire without opening said cases.

Research has been directed to reducing the cost of manufacturing the component parts, the cost of assembling these parts to form connective arrangements and the cost to installers of implementing such connective arrangements. This has resulted in simplified manufacturing, assembly, mounting and connective implementation also affording greater reliability and safety.

To this end this invention provides an arrangement for making electrical connections having a spring leaf controlled by a push-rod, whereby the end of a conductor constrained by clamping by the spring leaf against a conductive wall, termed the connecting wall, within a compartment in a case of insulating material into which the end of the conductor is previously inserted such as to fit between the connecting wall and the spring leaf.

The inventive connective arrangement comprises a push-rod to compress the spring leaf, which penetrates the compartment accommodating the spring leaf and which is maneuverable from the outside of the case to two positions, in one of which positions, termed the insertion position, the spring leaf is relaxed and allows the end of a conductor to be inserted between itself and the conducting wall and in the other of which positions, termed the clamping position, the spring leaf is flexed and bears against the push-rod and, directly or indirectly, via at least a conductor end so connected, against the connecting wall.

The invention, its features and advantages will now be described in greater detail with reference to the several appended figures, in which.

Figure 1:
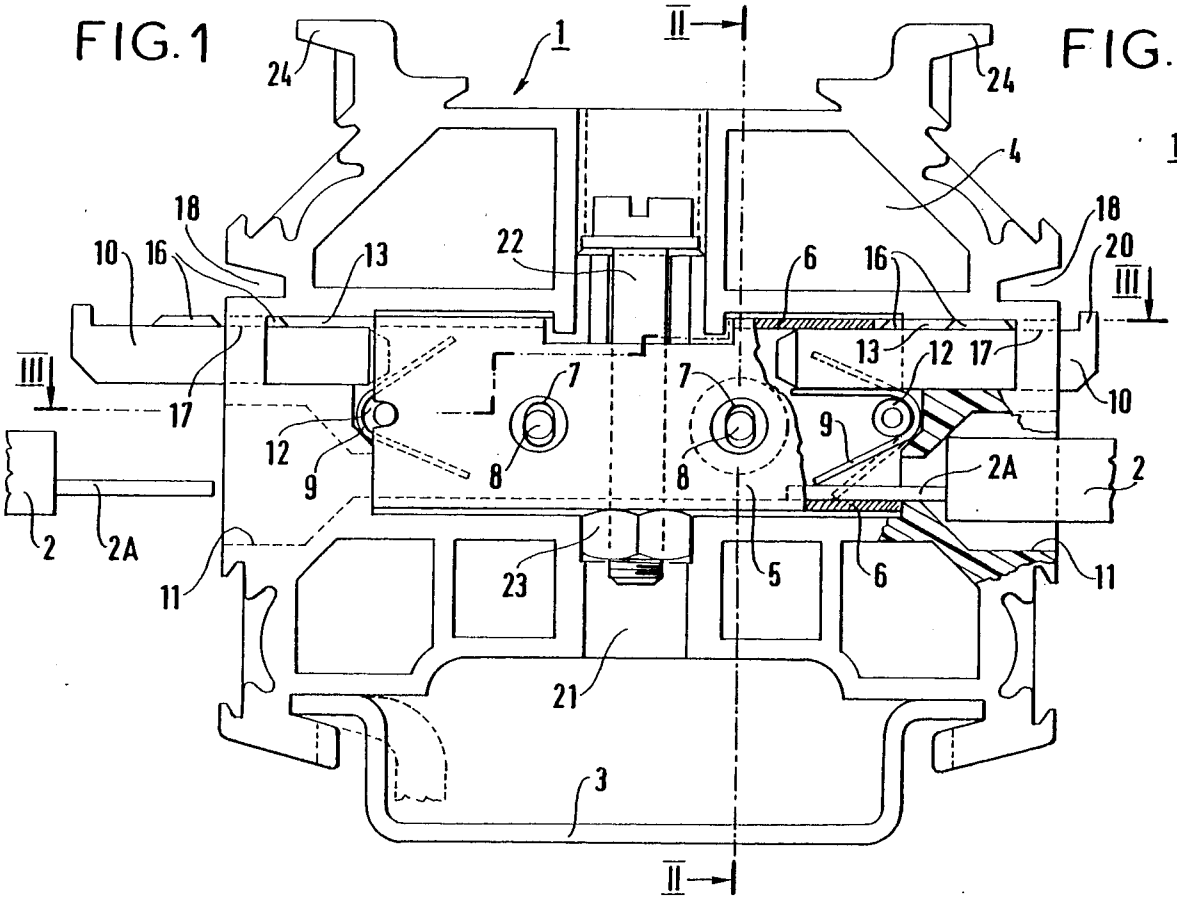
FIG. 1 is a front view, partly cut away, of an opened junction block containing two connective arrangements according to the invention.
Figure 4:
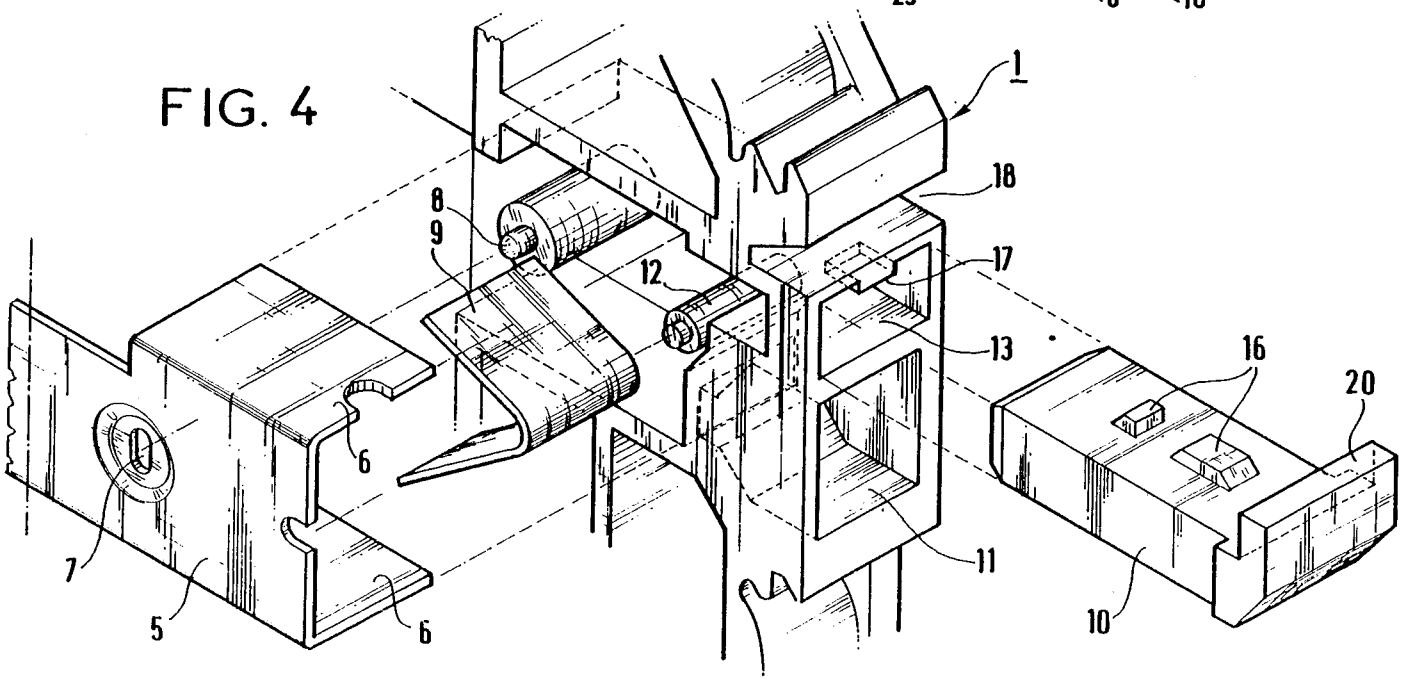

and FIG. 4 is an exploded view in perspective of a detail of the junction block of FIG. 1.

The arrangement for electrical connections according to the invention is presented in FIG. 1 in its application as a junction block 1 designed to interconnect the ends 2A of two conductors 2. It can obviously be used to connect an electrical wire to many other electrical devices, for example to a switch, a motor or other.

In the example proposed, the conductor ends 2A each consist of a wire terminating lug. The ends can also be pin-type terminations, or simply the stripped conductive center core of an insulated electrical wire.

The junction block 1 is shown here transversely, mounted on a supporting rail 3. It comprises a molded case 4 of insulating material in which at least one internal cavity or compartment is provided. This compartment typically encloses various devices distributed according to need and in particular the electrically conductive components of connective arrangements.

In the preferred embodiment, the case 4 comprises a solid broad face and an open face parallel thereto.

The case is closed either by a thin plate applied to the open broad face such as to close off the compartment or compartments in the latter face, or by the solid broad face of an identical or compatible case which one applies thereagainst.

In the preferred embodiment, the case 4 contains a metallic good conductor part 5 a wall 6 of which, termed the connecting wall, receives the ends 2A of the conductors to be connected.

Figure 2:
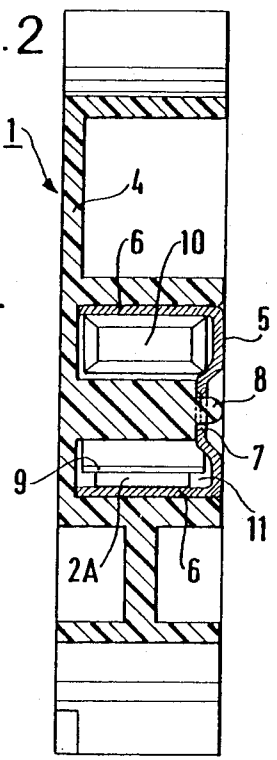
FIG. 2 shows a cross-section of the open junction block, taken along line II—II of FIG. 1, viewed from the left of that figure.

The metallic part 5 particularly illustrated is one with a U-shaped cross section mating by means of centered eyelets 7 with protuberances 8 on the case 1, as can be seen in FIGS. 1, 2 and 4. It becomes locked in a purposely provided accommodating shape 4 in the case 1, where it becomes precisely positioned, for example by an embedded fit. The connecting wall 6 is fixed and in this case is formed by one of the two side walls of the metallic part 5. It may alternatively consist of a simple straight blade of a conductive metal or even of a coating of conducting material.

In the given example, the connecting wall 6 is common to two connective arrangements, which it interconnects, each connective arrangement having a spring leaf 9 subjected to the action of a spring compressing push-rod 10.

Each spring leaf 9 is disposed in a compartment 4 of the case 1 also containing the accommodation for the metallic part 5.

One end of each spring leaf 9 positions itself next to the connecting wall 6 such as to firmly bear against it under the urging of a push-rod 10 and assume a clamping position, there being one push-rod per leaf in the example under consideration.

The spring leaf can be a simple straight blade driven into the wall of the case such that its free end rests slantedly near or against the connecting wall 6 when unconstrained. It allows insertion of an end 2A of a conductor 2 between the connecting wall 6 and itself, through an opening 11 in the case 4.

In the preferred embodiment, the leaf spring 9 is folded back in the manner of a hairpin and mounted to swivel about an axis—in this case, a swivel pin 12 molded as part of the case 1 in the compartment accommodating the leaf spring. The swivel pin is arranged parallel to and across from the connecting wall 6. The push-rod 10 here consists of a rod with a rectangular cross-section and slide in a guideway 13 extending parallel to the connecting wall 6, on the other side of the swivel pin 12 from the connecting wall 6 and debouching near the conductor end insertion opening 11, said opening typically being shaped as a funnel, as can be seen in FIGS. 1 and 4. The direction of insertion of the conductor end into the case, via opening 11, is substantially parallel to the guideway 13 and the connecting wall 6 with which said opening abuts.

The push-rod 10 is operable to move in its guideway between a position, termed insertion position, in which one of its ends projects substantially from the case 1 and its other end is removed from the swivel axis 12 of the spring leaf 9, which it releases, and nearer the region of said spring leaf surrounding the swivel pin.

The spring leaf 9 is here maintained in position around the swivel pin 12 by a suitable relief 14 in the case which, in a known manner, in practice allows only limited rotation of the spring leaf about its swivel pin and holds it substantially against said swivel pin.

One of the two arms of the spring leaf, termed the clamping arm, has its end at such time resting or located near the connecting wall 6, which allows an end 2A of a conductor 2 to be inserted betwen this clamping arm end and the connecting wall, with practically no insertion force. It is thus possible to insert flexible wires whose ends have simply been stripped of insulation.

Pushing in the push-rod by pressing on its outside and drives it to push with its other, inside end on the second arm of the spring leaf 9, termed the tensing arm.

To this end the push-rod 10 is made to slide along the tensing arm against which it laterally bears, firstly near the swivel pin 12, then further along the arm as it is gradually translated to its own clamping position.

The push-rod's lateral bearing on the tensing arm of the spring leaf 9 initially causes the spring leaf as a whole to swivel about its pin 12 before tensing it. The tensing arm is then intimately applied against the length of the push-rod 10 witin the spring compartment and the clamping arm is pushed against the connecting wall, either directly, or indirectly via the conductor end or ends now clamped by the clamping arm, it being understood that one can secure a plurality of stripped wire ends or like-sized terminating pins between a clamping arm and a connecting wall.

In an alternative embodiment, two hairpin spring leaves 9 can be urged by a same, single compressing push-rod 10, the leaves both bearing by a tensing arm of each, for example parallel to one another, against a different portion of the same face of the push-rod, or alternatively, against two, opposite, parallel faces of the push-rod.

The connecting openings 11 associated with each spring leaf would in one case be side by side on the same side of the corresponding push-rod and in the other case, aligned to each side of the push-rod.

In the case of the junction block illustrated, two compressing push-rods 10 are symmetrically arranged with respect to the center transverse plane, not specifically indicated in the drawing, of the case 1 and are each associated with an individual spring leaf 9 as well as with a common connecting wall 6. The hairpin spring leaves 9 are likewise symmetrically arranged with respect to the center transverse plane of the block. They thus enable connecting together two conductors, one being clamped by one spring leaf and the other by the other spring leaf, against the connecting wall.

Figure 3:
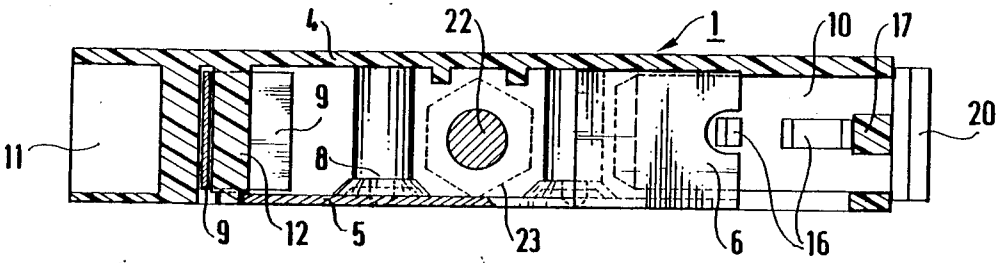
FIG. 3 shows a cross section of the open junction block, taken along line III—III of FIG. 1.

In the preferred embodiment where each push-rod 10 is formed of a sliding rod having a rectangular section in its sliding region, each rod also has a locking boss or catching means 16, represented merely for purposes of illustration in FIGS. 1, 3 and 4 as longitudinal, located on the opposite side of the push-rod from the side facing the tensing arm of the spring leaf in the assembled unit.

The longitudinal catching means 16 cooperates with a matching catch 17, more clearly drawn in FIG. 4, located at the mouth of the guideway 13 in which the push-rod 10 slides, to permit elastically locking the push-rod 10 in its two extreme positions, respectively termed the insertion and clamping positions.

The longitudinal catching means 16 in the embodiment illustrated consists of two catchs which cooperate with a low profile catch 17 provided as a relief within the guideway.

Prior to insertion of a wire end, the push-rod 10 projects from the case of the junction block in which position it is kept by the most inward catch of the catching means 16. When pressure is applied to the outside end of the push-rod 10, this drives the most outward catch of the longitudinal catching means 16 beneath the matching catching means 17 which moves up elastically with the wall of the guideway that carries it, this uplifting being favored by the notch 18 (FIGS. 1 and 4) provided in the case 4 above the mouth of the guideway 13. The inward driving of the push-rod is limited by the butting of the push-rod after complete passage of the most outward catch of catching means 16 beyond matching catching means 17 within the block, this passing locking the push-rod in clamping position.

The outward end of the push-rod outside the case 4 is given a bearing relief 20 to provide a purchase for the tip of some external tool, such as a screwdriver, not shown, enabling the push-rod 10 to be pulled back outside of the junction block for disconnecting purposes. In the preferred embodiment, a groove is provided between the wall of the case and the relief on the push-rod to introduce the tip of a tool such as to work lever-like against the relief 20 on the one hand and against the region of the case near the mouth of the guideway 13 on the other hand from which the rod projects. This makes it possible to partially extract the push-rod by forcing the most outward locking catch out beneath the matching catching means 17.

Incidentally illustrated, a center through channel 21 traverses the case 4 of the junction block perpendicularly to the metallic part 5 of which the connecting wall 6 is a part. This channel 21, formed as a U-shaped groove in the illustrated embodiment, can accommodate a bolt or rod 22 which in this case is secured by a nut 23 to the connecting part 5 through which it passes at the center of the connecting wall 6. The rod 22 makes it possible, for example, to make a grounding block, when lengthened such that it can be fastened to the supporting rail 3 provided for the purpose with a through hole allowing the rod 22 to pass therethrough and be secured by a nut, not shown.

The channel also enables a test point to be provided to check the electrical continuity of the connections made by means of the junction block.

Lastly, and likewise incidentally, it should be noted that the case 4 is arranged to be able to serve as a support for an identical or otherwise compatible case able to be hooked to the protrusions 24, just as the case 4 hooks onto the supporting rail 3, to enable stacking of compatible or like blocks.

Obviously, application of the arrangement for electrical connections according to the invention is not limited to the case of junction blocks and could be extended to use in numerous common electrical appliances, such as small switches and control apparatus.

What is claimed is:

1. An arrangement for electrical connections having a spring leaf controlled by a spring compressing push-rod, for at least one conductor end constrained and being clamped by the spring leaf against a fixed conductive connecting wall, within a compartment in a case of insulating material into which the end of the conductor is previously inserted so as to fit between the connecting wall and the spring leaf, wherein the spring-compressing push-rod is slidably positioned in a push-rod guideway, penetrates the compartment in which the leaf spring is located and is maneuverable from the outside of the case between an insertion position in which the spring leaf is relaxed and allows the end of a conductor to be freely inserted between the connecting wall and the leaf itself, and a clamping position, in which spring leaf is tensed and bears against said push-rod and directly or indirectly via at least one conductor end so connected, against the connecting wall, and wherein the spring leaf compressing push-rod consists of a sliding rod which cooperates with the spring leaf, and said spring leaf is folded back as a hairpin, having two arms and mounted to swivel about a swivel pin in the case compartment, said spring leaf being released or urged by the push-rod to swivel from a condition of relaxation of said two arms when the push-rod is in insertion position, to a condition of compression where the push-rod drives one of the leaf arms, termed the clamping arm, toward the connecting wall by pushing laterally on the other arm, termed the tensing arm.

2. Arrangement for electrical connections of the junction block type, according to claim 1, wherein two push-rods are provided and arranged symmetrically in relation to the transverse center plane of the case of insulating material into which each penetrates by one end, each push-rod being associated both with an individual spring leaf and with a common conducting wall at the two ends of which openings for inserting the ends of conductors to be connected are provided.

3. Arrangement for electrical connections according to claim 1, wherein the push-rod is placed in a position removed from the spring leaf's swivel axis when in wire insertion position and slides along the tensing arm of the spring leaf, bearing against said arm as it moves from insertion position to clamping position.

4. Arrangement for electrical connections according to claim 1, wherein catching means operable to cooperate with matching catching means in the push-rod guideway such as to become elastically locked in at least one of its positions, namely that of insertion or that of clamping.

5. Arrangement for electrical connetions according to claim 1, wherein the push-rod is provided at a maneuvering end with a relief to serve as a bearing for the tip of an external tool, said relief being accessible outside of the case and enabling the push-rod to be extracted and pulled out from its clamping position by working the tool tip as a lever between the said relief and the region of the case near a mouth of the guideway from which the push-rod projects from the case.

6. Arrangement for electrical connections according to claim 1, wherein a mouth of the guideway from which a push-rod projects and the opening for insertion of a wire end to be connected by actuating the push-rod are located side by side in the end of the case from which they emerge.

7. Arrangement for electrical connections according to claim 6, wherein said push-rod slides in a guideway extending parallel to the connecting wall, opposite the latter across from the swivel pin of the spring leaf on which said push-rod acts, the axis of the guideway from ts mouth being substantially parallel to the direction in which the end of a conductor is inserted through the insertion opening debouching from the case near said mouth.

* * * * *